US010788225B2

(12) United States Patent
Takeda et al.

(10) Patent No.: US 10,788,225 B2
(45) Date of Patent: Sep. 29, 2020

(54) AIR-CONDITIONING SYSTEM, CONTROLLER, AND PROGRAM

(71) Applicant: Mitsubishi Electric Corporation, Tokyo (JP)

(72) Inventors: Emi Takeda, Tokyo (JP); Masaki Toyoshima, Tokyo (JP); Takuya Furuhashi, Tokyo (JP); Sota Komae, Tokyo (JP); Fumihiko Sone, Tokyo (JP); Reiji Morioka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 242 days.

(21) Appl. No.: 15/567,436

(22) PCT Filed: Jul. 29, 2015

(86) PCT No.: PCT/JP2015/071464
§ 371 (c)(1),
(2) Date: Oct. 18, 2017

(87) PCT Pub. No.: WO2017/017804
PCT Pub. Date: Feb. 2, 2017

(65) Prior Publication Data

US 2018/0087792 A1 Mar. 29, 2018

(51) Int. Cl.
*F24F 11/00* (2018.01)
*F24F 11/89* (2018.01)
(Continued)

(52) U.S. Cl.
CPC ..... *F24F 11/0001* (2013.01); *F24F 7/06* (2013.01); *F24F 11/30* (2018.01); *F24F 11/48* (2018.01); *F24F 11/74* (2018.01); *F24F 11/755* (2018.01); *F24F 11/89* (2018.01); *F24F 11/32* (2018.01); *F24F 11/61* (2018.01); *F24F 13/22* (2013.01); *F24F 2110/00* (2018.01)

(58) Field of Classification Search
CPC ..... F24F 11/0001; F24F 11/89
USPC ..... 454/239, 256
See application file for complete search history.

(56) References Cited

U.S. PATENT DOCUMENTS 5,899,082 A * 5/1999 Stein ..... A61L 9/122 62/133
2012/0053738 A1* 3/2012 Lingrey ..... G05D 23/1905 700/278
2012/0186287 A1 7/2012 Kawai

FOREIGN PATENT DOCUMENTS

JP 07-012391 A 1/1995
JP 11-351645 A 12/1999
(Continued)

OTHER PUBLICATIONS

"Simple Steps to Troubleshoot a Frozen Evaporator Coil." Byrd Heating and Air Conditioning, Jul. 26, 2015, https://byrdheatingandair.com/articles/simple-steps-to-troubleshoot-a-frozen-evaporator-coil.*

(Continued)

*Primary Examiner* — Vivek K Shirsat
(74) *Attorney, Agent, or Firm* — Posz Law Group, PLC

(57) ABSTRACT

An air conditioning system includes: an air conditioning device, a ventilator, a sensor group, an operation terminal, and a control device installed in a building. The control device performs controlling and monitoring of operation of the air conditioning device and the ventilator. The control device controls the ventilator so as to operate during the maintenance operation of the air conditioning device.

12 Claims, 9 Drawing Sheets

(51) Int. Cl.

| | |
|---|---|
| ***F24F 11/755*** | (2018.01) |
| ***F24F 11/48*** | (2018.01) |
| ***F24F 11/74*** | (2018.01) |
| ***F24F 11/30*** | (2018.01) |
| ***F24F 7/06*** | (2006.01) |
| *F24F 11/32* | (2018.01) |
| *F24F 13/22* | (2006.01) |
| *F24F 11/61* | (2018.01) |
| *F24F 110/00* | (2018.01) |

(56) References Cited

FOREIGN PATENT DOCUMENTS

| | | | |
|---|---|---|---|
| JP | 2000-146259 | A | 5/2000 |
| JP | 2000-205638 | A | 7/2000 |
| JP | 2000-310437 | A | 11/2000 |
| JP | 2002-333158 | A | 11/2002 |
| JP | 2002-349891 | A | 12/2002 |
| JP | 2004-085044 | A | 3/2004 |
| JP | 2005-003321 | A | 1/2005 |
| JP | 2005-069588 | A | 3/2005 |
| JP | 2011-153817 | A | 8/2011 |
| JP | 2011-202892 | A | 10/2011 |
| JP | 2012-097999 | A | 5/2012 |
| JP | 2012-149855 | A | 8/2012 |

OTHER PUBLICATIONS

Office Action dated Jul. 2, 2019 issued in corresponding CN patent application No. 201580080460.2 (and English translation).
Extended European Search Report dated May 3, 2019 issued in corresponding EP patent application No. 15899637.1.
Office Action dated Jun. 5, 2018 issued in corresponding JP patent application No. 2017-530534 (and English translation).
International Search Report of the International Searching Authority dated Oct. 20, 2015 for the corresponding international application No. PCT/JP2015/071464. (English translation attached).
Office Action dated Dec. 30, 2019 issued in corresponding CN patent application No. 201580080460.2 (and English translation).
Office Action dated Apr. 22, 2020 issued in corresponding EP patent application No. 15899637.1.
Office Action dated Jul. 21, 2020 issued in corresponding CN patent application No. 201580080460.2 (and English translation).

* cited by examiner

FIG. 6

PROCESSING RESULT SCREEN

1. An air conditioning device operated in the below manner.

| | |
|---|---|
| INSTALLATION LOCATION | LDK |
| OPERATION MODE | MAINTENANCE OPERATION |
| START TIME | 2015.05.01 18:00 |
| END TIME | 2015.05.01 18:30 |

2. A ventilator operated in the below manner in conjunction with the operation of the air conditioning device.

| | |
|---|---|
| INSTALLATION LOCATION | LDK |
| START TIME | 2015.05.01 18:00 |
| END TIME | 2015.05.01 18:30 |

FIG. 8

| OPERATION MODE OF AIR CONDITIONING DEVICE | IN-CONJUNCTION VENTILATOR CONTROL | |
|---|---|---|
| | CONTROL CONTENT | AIR FLOW STRENGTH |
| MAINTENANCE OPERATION | IN-OPERATION CONTROL | HIGH |
| HEATING OPERATION, COOLING OPERATION | STARTUP CONTROL, INTERMITTENT CONTROL | MEDIUM |
| DEHUMIDIFYING OPERATION | STARTUP CONTROL | MEDIUM |
| AIR BLOWING OPERATION | STARTUP CONTROL | LOW |

AIR-CONDITIONING SYSTEM, CONTROLLER, AND PROGRAM

CROSS REFERENCE TO RELATED APPLICATION

This application is a U.S. national stage application of International Patent Application No. PCT/JP2015/071464 filed on Jul. 29, 2015, the disclosure of which is incorporated herein by reference.

TECHNICAL FIELD

The present disclosure relates to an air conditioning system, a control device, and a program that are used for performing air conditioning of a target space to be air conditioned.

BACKGROUND ART

Mold and/or odor is caused by moisture attached to an internal component of an air conditioner such as a heat exchanger. Thus an air conditioner is known that prevents the occurrence of such mold and/or odor, by running (maintenance operation) the air conditioner in a maintenance mode after stopping of a cooling operation, and evaporating water droplets attached to the heat exchanger.

Patent Literature 1 describes an air conditioner that, when an operation is performed causing the air conditioner to halt, displays contents of the maintenance operation and an operation time of the maintenance operation on a remote controller.

CITATION LIST

Patent Literature

Patent Literature 1: Unexamined Japanese Patent Application Kokai Publication No. 2012-149855

SUMMARY OF INVENTION

Technical Problem

Performing of the maintenance operation results in an increase in humidity of the room in which the air conditioner is installed, and this increased humidity causes a problem in that user comfort decreases.

The present disclosure is developed in consideration of the aforementioned circumstances, and an object of the present disclosure is to provide an air conditioning system and the like that are capable of improving comfort of the user during the maintenance operation.

Solution to Problem

In order to attain the aforementioned object, the air conditioning system of the present disclosure includes:

an air conditioning device configured to condition air in a target space to be air conditioned;

a ventilator configured to ventilate the target space to be air conditioned; and a ventilation controller configured to control the ventilator to operate during a maintenance operation of the air conditioning device.

Advantageous Effects of Invention

According to the present disclosure, the air conditioning system is controlled such that the ventilator operates during the maintenance operation of the air conditioner, thereby enabling prevention of an unnecessary increase of humidity during the maintenance operation. Thus user comfort can be increased during the maintenance operation.

BRIEF DESCRIPTION OF DRAWINGS

FIG. 6 is a drawing illustrating an example of a processing result screen;

FIG. 8 is a drawing illustrating an example configuration of a control table.

DESCRIPTION OF EMBODIMENTS

Figure 1:
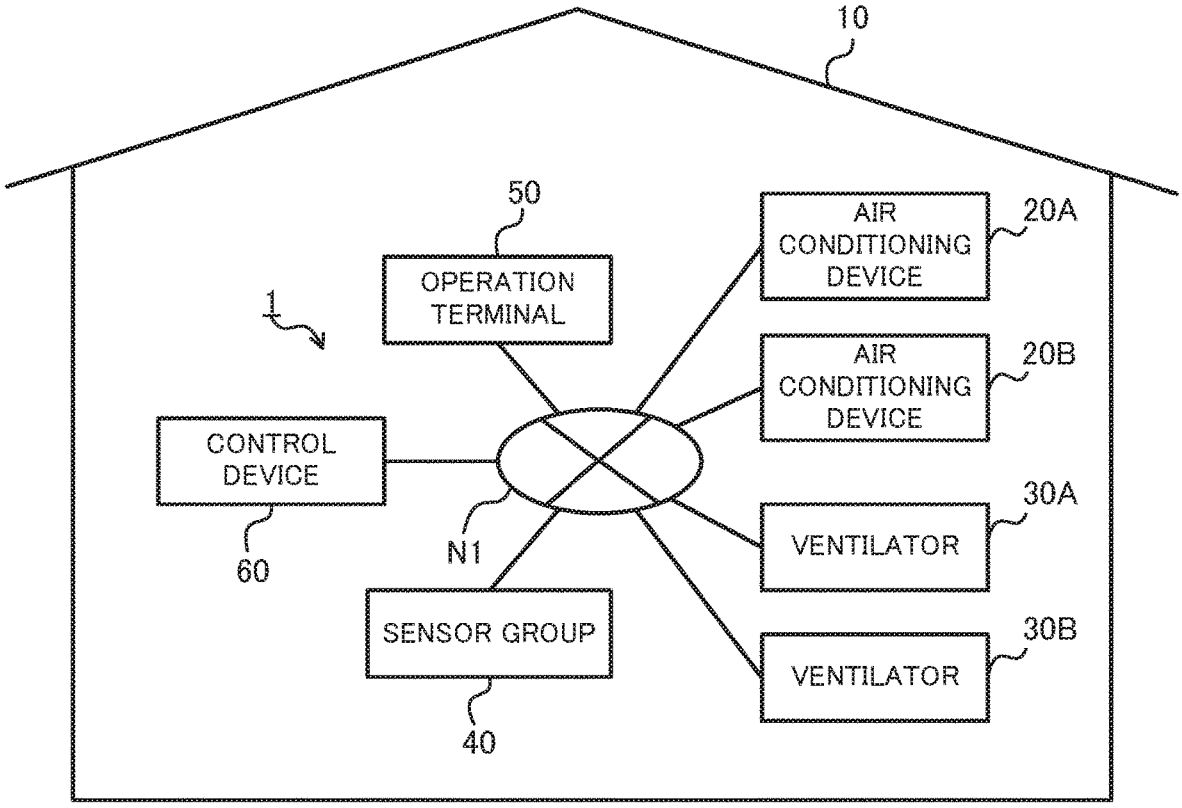
FIG. 1 is a drawing illustrating configuration of an air conditioning system according to an embodiment of the present disclosure.

Various embodiments of the present disclosure are described below in detail with reference to drawings. In the drawings, components that are the same or equivalent are assigned the same reference signs.

An air conditioning system 1 according to an embodiment of the present disclosure is described below. The air conditioning system 1 is a system for performing air conditioning of a target space to be air conditioned. Further, the term "air conditioning" here includes actions such as heating, cooling, dehumidifying, humidifying, purifying, and the like of the target space to be air conditioned. As illustrated in FIG. 1, the air conditioning system I includes air conditioning devices 20 (20A and 20B), ventilators 30 (30A and 30B), a sensor group 40, an operation terminal 50, and a control device 60 installed in a building 10. Further, the control device 60, the air conditioning devices 20, the ventilators 30, the sensor group 40, and the operation terminal 50 are communicatively interconnected via an indoor network N1 such as a local area network (LAN).

The air conditioning devices 20 are, for example, air conditioners and have a function for air conditioning the target space to be air conditioned. The air conditioning devices 20 have multiple operation modes and perform a type of air conditioning corresponding to a presently set operation mode. For example, the air conditioning devices 20 have operation modes such as a maintenance mode in which the heat exchanger is heated to vaporize attached moisture, a cooling mode for cooling operation, a heating mode for heating operation, an air blowing mode for air blowing operation, a dehumidification mode for dehumidification operation, and the like.

Figure 2:
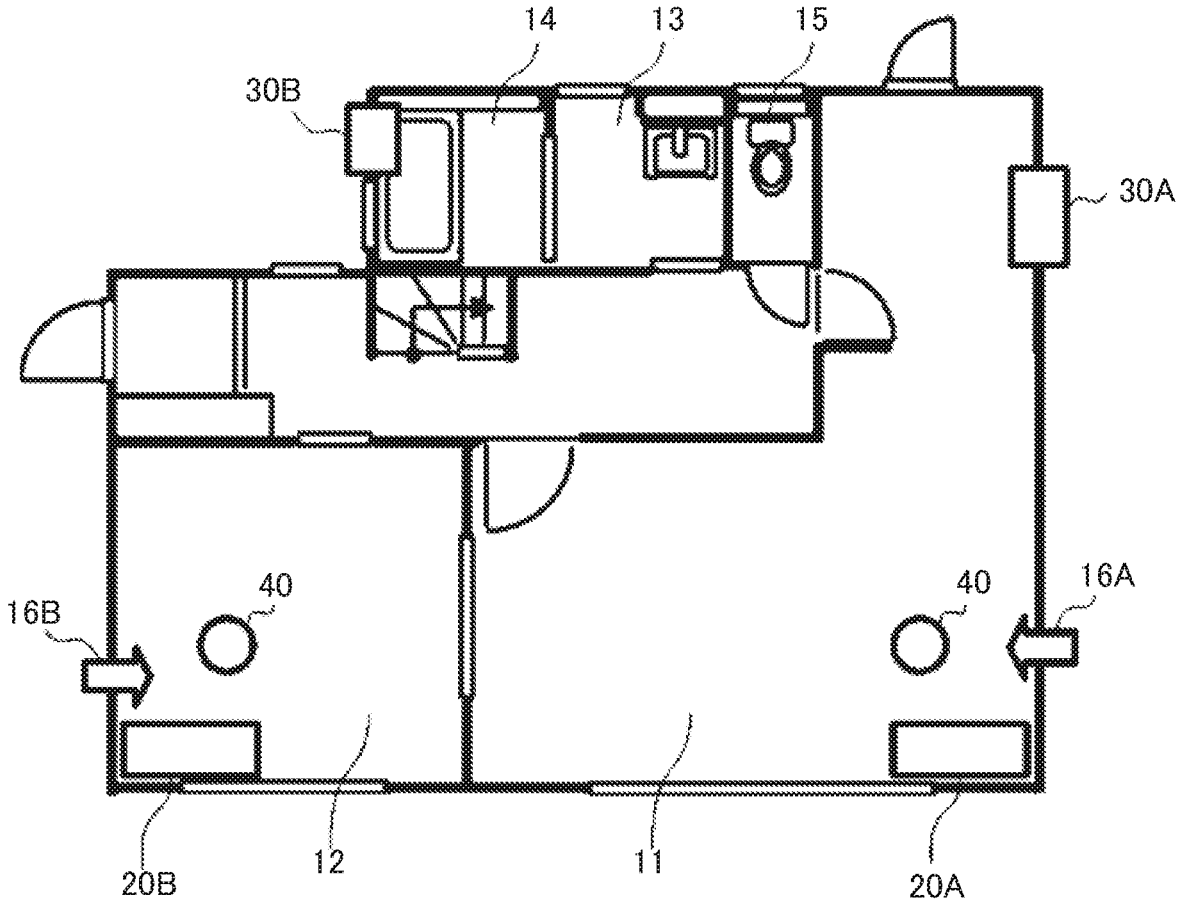
FIG. 2 is a drawing illustrating layout of a building in which an air conditioning device and a ventilator are installed.

Further, as illustrated in FIG. 2, a first floor portion of a building 10 has a living-dining-kitchen room (LDK) 11, a private room 12, a sink room 13, a bathing room 14, and a toilet room 15. The air conditioning device 20A is installed in a wall of the LDK 11. The air conditioning device 20B is installed in a wall of the private room 12 that is the target space to be air conditioned. The air conditioning device 20A sucks air into the LDK 11, blows the air conditioned (cooled, heater, dehumidified, humidified, and the like) air into the LDK 11, and thus air conditions the interior of the LDK 11. The air conditioning device 20B sucks air into the private room 12, which is the target space to be air conditioned, and blows the air conditioned air into the private room 12, thereby air conditioning the interior of the private room 12.

Figure 3:
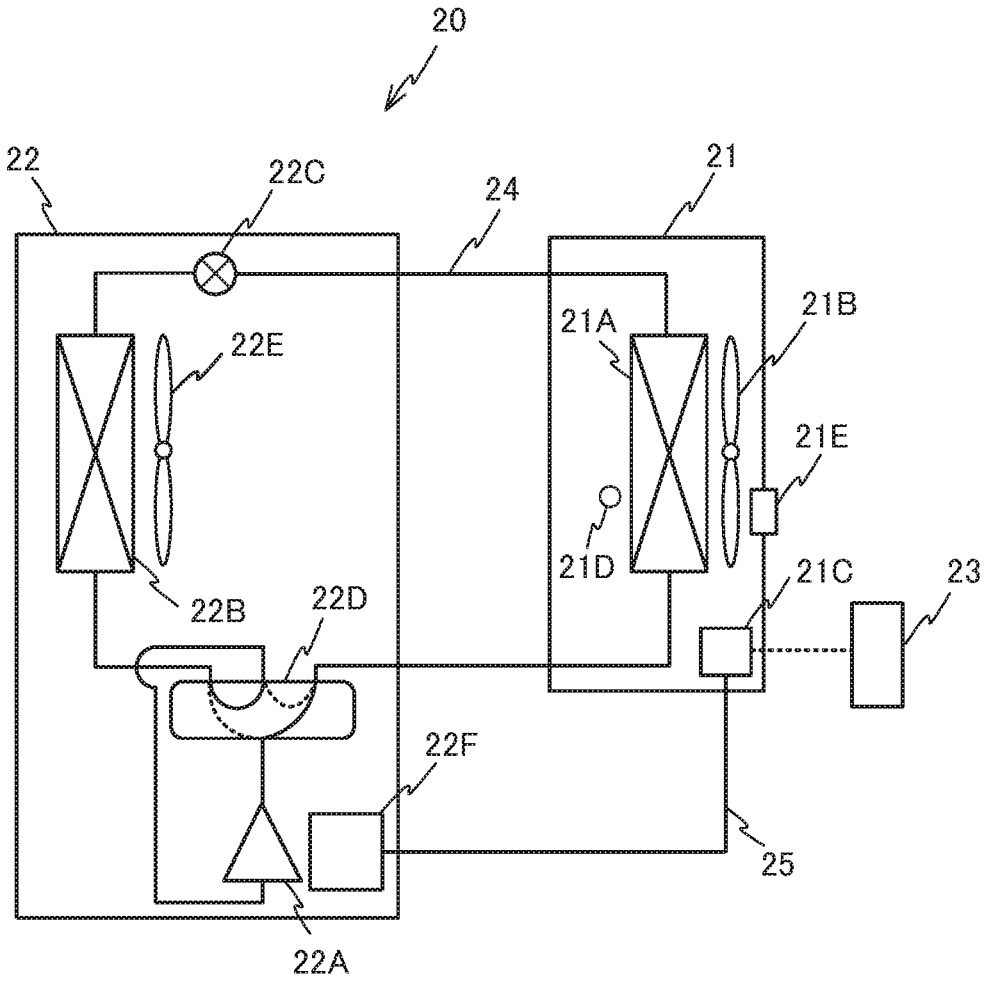
FIG. 3 is a drawing illustrating configuration of the air conditioning device.

Configuration of the air conditioning device 20 is described below. The air conditioning device 20, as illustrated in FIG. 3, includes an indoor unit 21, an outdoor unit 22, and a remote controller 23.

The indoor unit 21 is installed in a wall of a room (LDK 11, private room 12) within the building 10 and performs heating and cooling by hot and cold air blown out by the indoor unit 21. Further, the air conditioning device 20 is equipped with a vapor-compression type heat pump, and the indoor unit 21 and the outdoor unit 22 are interconnected via a communication line 25 and a refrigerant line 24 through which refrigerant flows.

The indoor unit 21 is equipped with an indoor heat exchanger 21A. The outdoor unit 22 is equipped with a compressor 22A, an outdoor heat exchanger 22B, an expansion valve 22C, and a four-way valve 22D. A refrigeration cycle is formed by connecting together these devices in a loop by a refrigerant line 24.

Further, the indoor unit 21 is equipped with an indoor blower 21B that blows air through the indoor heat exchanger 21A and into the building 10, an indoor unit controller 21C that controls operation of various components of the indoor unit 21, a temperature sensor 21D that measures temperature of the intake air, an infrared sensor 21E that measures temperature within the building 10, and the like. Further, the outdoor unit 22 is equipped with an outdoor blower 22E that sucks in and blows out exterior air, and an outdoor unit controller 22F that controls various components of the outdoor unit 22.

The remote controller 23 is equipped with multiple buttons and the like. The remote controller 23 is operated by a user and sends to the indoor unit controller 21C a control command in accordance with the operation. The indoor unit controller 21C executes processing in accordance with the received control command. For example, upon receiving a cooling-start command from the remote controller 23, the indoor unit controller 21C controls the various components and starts the cooling operation.

Operation during each of the operating modes of the air conditioning device 20 is described below. For example, in the case of operation of the air conditioning device 20 in the cooling mode or dehumidification mode, by control of the outdoor unit controller 22F and the indoor unit controller 21C, the refrigerant discharged from the compressor 22A passes through the four-way valve 22D and flows to the outdoor heat exchanger 22B. The refrigerant flowing into the outdoor heat exchanger 22B exchanges heat and condenses, and then flows to the expansion valve 22C. After depressurization of the refrigerant by the expansion valve 22C, the refrigerant flows to the indoor heat exchanger 21A. Further, the refrigerant flowing into the indoor heat exchanger 21A exchanges heat and evaporates, and then passes through the four-way valve 22D and again is sucked into the compressor 22A.

Thus the refrigerant at low pressure and low temperature flows within the tubing of the indoor heat exchanger 21A, the surface of the indoor heat exchanger 21A becomes cold, and the air passing through the indoor heat exchanger 21A is cooled. Further, under the control of the indoor unit controller 21C, the indoor blower 21B blows cold air passing through the indoor heat exchanger 21A to perform cooling or dehumidification. Further, droplets of water obtained from the air attach to the surface of the indoor heat exchanger 21A during such operation, and such water droplets cause the generation of unpleasant air.

Further, in the case of operation of the air conditioning device 20 in the air blowing mode, the indoor unit controller 21C performs control such that only the indoor blower 21B operates (blows air). In this case, the compressor 22A does not operate, and thus temperature of the air passing through the indoor heat exchanger 21A does not change.

Further, in the case of operation of the air conditioning device 20 in the heating mode, by control of the outdoor unit controller 22F and the indoor unit controller 21C, the refrigerant discharged from the compressor 22A passes through the four-way valve 22D and flows to the indoor heat exchanger 21A. The refrigerant flowing into the indoor heat exchanger 21A exchanges heat, condenses, and flows to the expansion valve 22C. After decompression by the expansion valve 22C, the refrigerant flows to the outdoor heat exchanger 2213. Then the refrigerant flowing into the outdoor heat exchanger 22B exchanges heat with the air, evaporates, then passes through the four-way valve 22D, and again enters the compressor 22A.

Thus the refrigerant at high pressure and high temperature flows within the tubing of the indoor heat exchanger 21A, the surface of the indoor heat exchanger 21A becomes hot, and the air flowing therethrough is heated. Then wider control of the indoor unit controller 21C, the indoor blower 21B performs heating by blowing the hot hair passing through the indoor heat exchanger 21A.

Further, in the case of operation of the air conditioning device 20 in the maintenance mode, by control of the outdoor unit controller 22F and the indoor unit controller 21C, the air conditioning device 20 performs the heating operation or the air blowing operation. Such operation evaporates the water droplets attached to the surface of the indoor heat exchanger 21A during the cooling operation and/or dehumidifying operation, and prevents growth of mold and the like. Further, the air conditioning device 20 may automatically execute the maintenance operation when the cooling operation and/or the dehumidifying operation stops. Further, a problem occurs during the maintenance operation due to blowing out of humid air.

Again with reference to FIG. 1, the ventilator 30 is a range hood fan, a bathing room ventilation fan, a toilet ventilation fan, an indoor ventilation fan, or the like, and exchanges indoor and outdoor air (ventilates).

Further, as illustrated in FIG. 2, a ventilator 30A is installed in a wall of the LDK 11. Further, the wall of the LDK 11 is equipped with an air supply port 16A. The ventilator 30A discharges air inside the LDK 11 to the exterior. Further, due to this discharge of air, pressure within the LDK 11 is low in comparison to exterior pressure, and thus exterior air is supplied from the air supply port 16A, and air within the LDK 11 is exchanged.

Further, as illustrated in FIG. 2, a ventilator 30B is installed in the wall of the bathing room 14. Further, the wall of the private room 12 is equipped with an air supply port 16B. The ventilator 30B discharges air from the bathing room 14 to the exterior. Further, due to this discharge of air, pressure within the entire house is low in comparison to exterior pressure, and thus exterior air is supplied from the air supply port 16A and the air supply port 169, and air is exchanged throughout the entire house.

Again with reference to FIG. 1, the sensor group 40 is a group of sensors installed in the building 10, such as a temperature sensor, a humidity sensor, a human-presence sensor, an odor sensor, a dust sensor, and the like, which senses various types of information and transmits the sensing result to the control device 60 as required. Further, as illustrated in FIG. 2, the sensor group 40 is installed in the LDK 11 and the private room 12 equipped with the air conditioning devices 20A and 20B. Further, the temperature sensor 21D and/or the infrared sensor 21E included in the air conditioning devices 20 may be taken to be a part of the sensor group 40.

Again with reference to FIG. 1, the operation terminal 50 is, for example, a dedicated remote controller, a tablet terminal, a smart phone, a wall-mounted monitor, a mobile phone, a television, or a personal computer (PC). The operation terminal 50 includes components such as a touch panel, and is used for sending to the control device 60 an operation signal for operating the air conditioning devices 20, displaying various types of conditions, and the like. Further, the operation terminal 50 is used for inputting a schedule of the user, transmitting the inputted schedule to the control device 60, and recording the transmitted schedule as schedule data. Further, the schedule data includes information such as times at which each user goes outside, times at which each room is occupied, and the like. Further, in below-described ventilation control processing, the operation terminal 50 functions as the display of the present disclosure for display that associates the information relating to the operation of the air conditioning devices 20 with information relating to operation of the ventilators 30 that have operation triggered by operation of the air conditioning devices 20.

Figure 4:
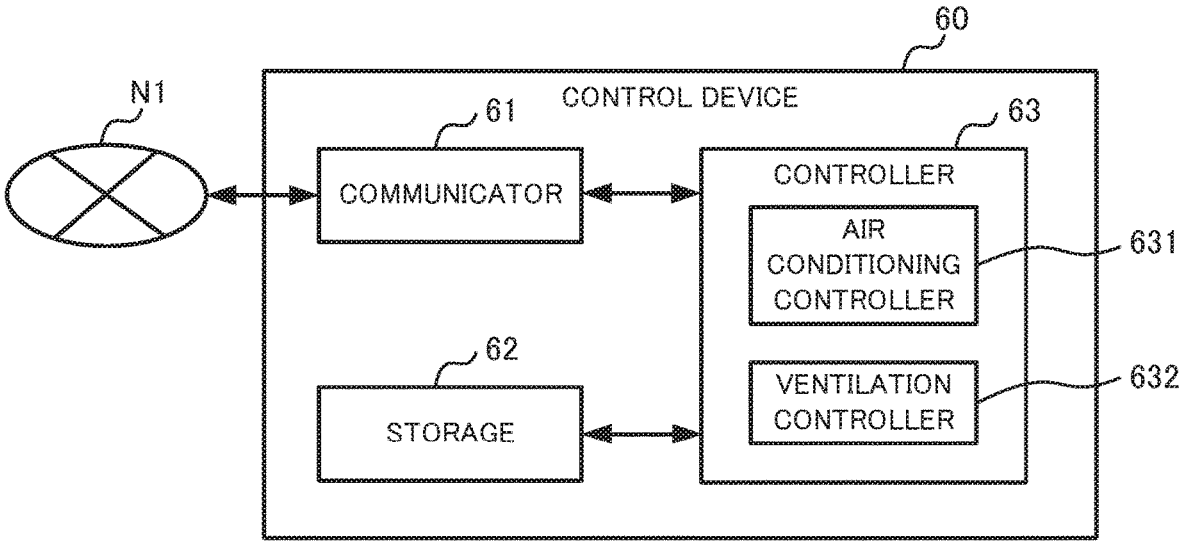
FIG. 4 is a block diagram of a control device.

The control device 60 is a computer that performs control and monitoring of operation of the air conditioning devices 20 and the ventilators 30. The control device 60, as illustrated in FIG. 4, is equipped with a communicator 61, a storage 62, and a controller 63.

The communicator 61 is equipped with a communication interface such as a network interface card (NIC) or the like, for example. Under the control of the controller 63, the communicator 61 performs data communication via the indoor network N1 with the air conditioning devices 20, the ventilators 30, the operation terminal 50, and the sensor group 40.

The storage 62 performs the role of a so-called secondary memory device (auxiliary memory device), and includes memory such as readable/writable non-volatile semiconductor memory such as flash memory. For example, the storage 62 contains schedule data indicating presence or absence of a user in various rooms of the building 10, data indicating names and types of the air conditioning devices 20 and the ventilators 30, installation locations and the like of the air conditioning devices 20 and the ventilators 30 within the building 10, and data indicating layout and the like of the building 10. Further, the storage 62 sequentially stores the newest information sensed by the sensor group 40. Further, the storage 62 stores data specifying sets of the air conditioning devices 20 and the ventilators 30 operated in conjunction by the below-described ventilation control processing. Specifically, the storage 62 stores data specifying a set of the air conditioning device 20A and the ventilator 30A and a set of the air conditioning device 20B and the ventilator 30B.

The controller 63 is equipped with a central processing unit (CPU), a read only memory (ROM), a random access memory (RAM), and the like, none of which are illustrated, and the CPU uses the RAM as working memory to control the aforementioned various components by suitable execution of various types of programs stored in the ROM and/or the storage 62. Further, the controller 63, is equipped with, as a functional configuration according to the present disclosure, an air conditioning controller 631 and a ventilation controller 632.

The air conditioning controller 631 controls the operation of the air conditioning devices 20. For example, when the air conditioning devices 20 are given an operation instruction from the operation terminal 50, the air conditioning controller 631 creates an operation command in accordance with the instruction and transmits the operation command to air conditioning devices 20 to control the air conditioning devices 20.

The ventilation controller 632 controls operation of the ventilator 30. For example, when the ventilators 30 are given an operation instruction from the operation terminal 50, the ventilation controller 632 creates an operation command in accordance with the instruction and transmits the operation command to ventilators 30 to control the ventilators 30. Further, the ventilation controller 632 controls the operation of the ventilators 30 in conjunction with the operation of the air conditioning devices 20.

Next, ventilation control processing is described in which, when operation of the air conditioning devices 20 is started, the control device 60 controls operation of the ventilators 30 in accordance with the operation mode.

At a prescheduled timing or when an instruction to start operation is received from the operation terminal 50, the air conditioning controller 631 of the control device 60 transmits to the air conditioning devices 20 an operation start command commanding start of operation in a specific operation mode. After the start of operation in the operation mode as instructed by the operation start command, the air conditioning devices 20 transmit an operation start notification to the control device 60. Upon receiving the operation start notification from the air conditioning devices 20, the ventilation controller 632 of the control device 60 executes the ventilation control processing illustrated in the flow chart of FIG. 5. Further, the ventilation control processing may be executed even in the case in which the air conditioning devices 20 start operation due to the control command from the remote controller 23 of the air conditioning devices 20, and notification of the start is sent to the control device 60.

Firstly, the ventilation controller 632 refers to the received operation start notification and determines whether the operation mode of operation started by the air conditioning device 20 is the maintenance mode (step S101).

In the case in which the operation mode is the maintenance mode (YES in step S101), during the time period in which the air conditioning device 20 operates, the ventilation controller 632 causes operation of the ventilator 30 associated so as to operate in conjunction with the air conditioning device 20. That is to say, the ventilation controller 632 transmits to the ventilator 30 the operation start command commanding the start of operation, and causes the ventilator 30 to start operation (step S102). Then the ventilation controller 632 waits until operation of the air conditioning device 20 stops (NO in step S103), and when operation of the air conditioning device 20 is stopped (YES in step S103), the ventilation controller 632 transmits an operation stop command commanding that the ventilator 30 stop operation, and the ventilation controller 632 causes the ventilator 30 to stop operation (step S104).

Thereafter the ventilation controller 632 creates processing result screen data that indicates associations between information relating to operation of the air conditioning device 20 serving as the trigger for the present ventilation control processing and the information relating to operation of the ventilator 30 operated in conjunction with operation of this air conditioning device 20, the ventilation controller 632 transmits to the operation terminal 50 and causes display of the screen data (step S105), and then ventilation control processing ends. Further, the ventilation controller 632 may cause display of the processing result screen by a PC, smartphone, or the like of the user, rather than by the operation terminal 50.

Here, FIG. 6 illustrates an example screen of the processing result screen. As may be understood from this screen, during the maintenance operation of the air conditioning device 20A installed in the LDK 11, the ventilator 30A installed in the LDK 11 is operated in conjunction with the maintenance operation of the air conditioning device 20A.

Again with reference to FIG. 5, however, in the case of prior start of operation of the air conditioning device 20 in an operation mode other than the maintenance mode, that is, in the cooling mode, heating mode, or the like (NO in step S101), the ventilation controller 632 causes operation of the ventilator 30 associated so as to operate in conjunction with the air conditioning device 20 for which there is prior start of operation at a predetermined time. That is to say, the ventilation controller 632 transmits the operation start command to the ventilator 30, thereby causing the start of operation (step S106). Then the ventilation controller 632 waits until the predetermined time period (for example, 10 minutes) elapses (NO in step S107), and upon passage of the time period (YES in step S107), the ventilation controller 632 transmits the operation stop command to the ventilator 30, thereby causing stoppage of operation (step S104). Further, the aforementioned processing screen is then displayed (step S105), and the ventilation control processing ends.

In this manner, in accordance with the present embodiment, the control device 60 controls the ventilator 30 to operate during the maintenance operation. Such control enables prevention of unnecessary increase of humidity by the maintenance operation. Thus user comfort during the maintenance operation can be improved. Further, due to the ventilator 30 being controlled in conjunction with operation of the air conditioning device 20, the user can be saved from the time and effort of operating the ventilator 30.

Further, according to the present embodiment, in the case in which there is the prior start of the operation other than the maintenance operation such as the cooling operation, heating operation, or the like, the ventilation by the ventilator 30 is performed only for the predetermined time period after the start of operation. Thus the unpleasant air that has a problem of being generated immediately after the start of operation of the air conditioning device 20 can be vented. Further, the ventilator 30 is operated only for the predetermined time period after the start of operation, thereby enabling prevention of lowering of efficiency of the cooling operation or warming operation of the air conditioning device 20 due to operation (venting) of the ventilator 30.

Modified Example

The present disclosure is not limited to the aforementioned embodiment, and naturally the present disclosure includes various types of modifications of parts without departing from the scope of the present disclosure.

For example, although operation of the ventilator 30 is started and stopped immediately after the starting and stopping of the maintenance operation of the air conditioning device 20 in the aforementioned embodiment, the operation of the ventilator 30 may be started and stopped after passage of a predetermined time period (for example, 5 minutes). Further, temperature of the air blown out from the air conditioning device 20 during the start of the maintenance mode can be determined from the sensor group 40, or the temperature sensor 21D, the infrared sensor 21E, or the like with which the air conditioning device 20 is equipped, and start of operation may be limited to only when the temperature is greater than or equal to a threshold.

Figure 7:
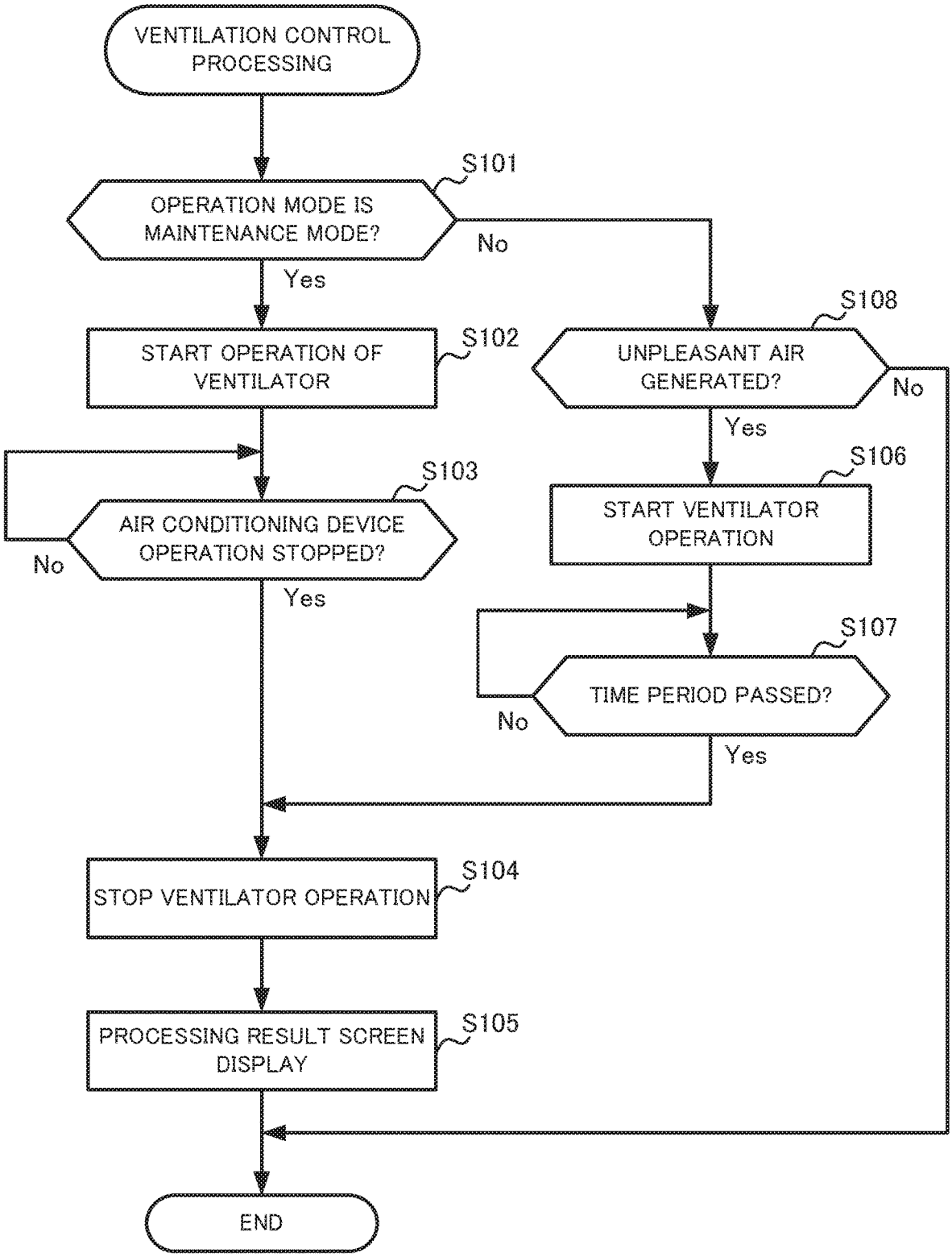
FIG. 7 is a flow chart for description of operation of ventilation control processing according to another embodiment.

For example, if the result of sensing by the sensor group 40 enables the determination of the whether unpleasant air is generated, then the ventilation control processing may be executed while taking into consideration the results of the determination. FIG. 7 is a drawing illustrating one example of a flow chart of ventilation control processing taking into consideration whether the unpleasant air is generated. Further, in the below description, the same numbers are assigned to steps that are the same as the steps of the ventilation control processing illustrated in FIG. 5, and description of such steps is suitably simplified.

Figure 5:
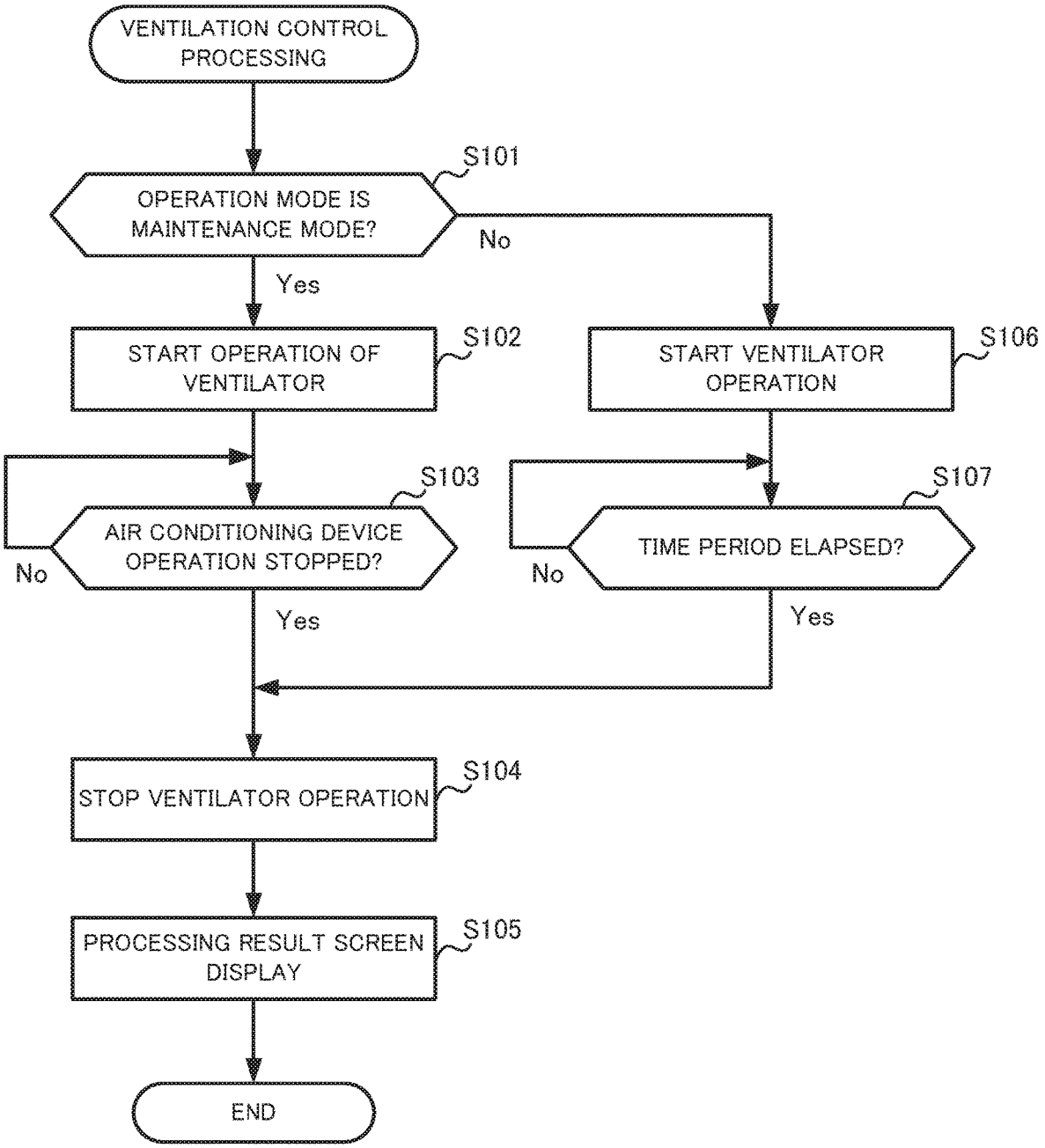
FIG. 5 is a flow chart for description of operation of ventilation control processing.

Upon the start of ventilation control processing, the ventilation controller 632 determines the operation mode of the air conditioning device 20 for which there is prior start of operation (step S101), and in the case of the maintenance mode (YES in step S101), in the same manner as the flow chart illustrated in FIG. 5, the ventilation controller 632 causes the ventilator 30 to operate during the operation of the maintenance mode (steps S102 to S105).

Alternatively, in the case in which the operation mode of the air conditioning device 20 is not the maintenance mode (NO in step S101), the ventilation controller 632, on the basis of the sensing result of the sensor group 40, determines whether the unpleasant air is generated from this air conditioning device 20 (step S108). For example, in the case of the dust level and/or odor level of the air sensed by the sensor group 40 being greater than or equal to a threshold, the ventilation controller 632 may determine that the unpleasant air is being generated.

In the case of determination that the unpleasant air is not being generated (NO in step S108), performance of ventilation is unnecessary, and thus the ventilation control processing ends. Alternatively, in the case of determination that the unpleasant air is being generated (YES in step S108), the ventilation controller 632, in the same manner as in the flow chart illustrated in FIG. 5, at a predetermined time causes operation of the ventilator 30, which is installed in the same room as that in which of the air conditioning device 20 that previously starting operation (steps S106, S107, S104, and S105).

In this manner, the ventilation control processing is performed while taking into consideration the occurrence of the generation of the unpleasant air, and thus in the case in which the unpleasant air is not generated when operation of the air conditioning device 20 starts in the operation mode other than the maintenance mode, control is possible that does not cause operation of the ventilator 30. Thus reduction of electricity expense is possible. Further, in the case in which detailed distinction is possible of the extent (degree of unpleasantness) of the unpleasant air on the basis of the sensing result of the sensor group 40, the ventilation controller 632 may perform control such as control that lengthens an operation time period of the ventilator 30 with increasing degree of unpleasantness, that operates at increasing air flow rate with increasing degree of unpleasantness, and the like.

Further, in the aforementioned embodiment, determination is made as to whether the operation mode of the air conditioning device 20 is the maintenance mode or is a mode other than the maintenance mode, and control of the ventilator 30 is performed as two types of control in accordance with the determination result. However, the ventilator 30 may be controlled more finely in accordance with the operation mode. For example, the storage 62 may contain a control table illustrated in FIG. 8, and the ventilation controller 632 may execute the ventilation controller processing in accordance with the control table.

That is to say, the ventilation controller 632 references this control table, and in the case in which the maintenance operation is being performed by the air conditioning device 20, during the time period of such operation, controls the ventilator 30 (in-operation control) so as to operate the at a high (strong) air flow strength. Unpleasantness during the maintenance operation can be further prevented by this means.

Further, the ventilation controller 632 references this control table, and in the case in which the air conditioning device 20 is performing the heating operation or the cooling operation, controls the ventilator 30 (start-up control) so as to operate at an medium air flow strength during a fixed time period after the start of such operation. Further, at fixed time intervals thereafter (for example, at each hour thereafter), the ventilation controller 632 controls the ventilator 30 so as to operate at the medium air flow strength for a predetermined time period (for example, 5 minutes). In addition to removing the unpleasant air, the generation of which is problematic at the startup of operation of the air conditioning device 20, this enables automatic performance also of periodic ventilation of the room during the time period of the cooling or heating operation.

Further, the ventilation controller 632 refers to this control table, and in the case in which the dehumidifying operation or air blowing operation is previously started by the air conditioning device 20, controls (startup control) the ventilator 30 such that the air flow strength is "medium" or "low" for a fixed time period after the start of such dehumidifying operation or air blowing operation. This enables removal of the unpleasant air, the generation of which is problematic at the startup of operation of the air conditioning device 20.

Further, the aforementioned control table may be configured such that the control table is freely editable by the user operating the operation terminal 50.

Further, the control device 60 may execute different types of control depending on whether the user is present in the room or absent from the room. For example, the air conditioning controller 631 of the control device 60 determines that the user is absent from the LDK 11 or the private room 12 by referring to the sensing result of the human-presence sensor or the like of the sensor group 40, or by referring to the schedule data of the user stored in the storage 62. Also, the air conditioning controller 631 may control the air conditioning device 20 so as to operate in the maintenance mode when the user is absent. By performing control in this manner, the maintenance operation can be executed automatically, thus enabling a lessening of the time and effort of operation by the user. Further, the maintenance operation is performed when the user is absent, thus enabling further improvement of comfort of the user.

Further, in the aforementioned ventilation control processing, the ventilation controller 632 of the control device 60 may control the ventilator 30, in the case in which the user is absent, so as to operate at a higher ventilation rate (air flow rate) than when the user is present. The performance of control in this manner when the user is absent enables efficient ventilation at high air flow rate regardless of noise.

Further, although in the aforementioned embodiments the case is described in which the air conditioning device 20 is an air conditioner, the air conditioning device 20 of the present disclosure is not limited to an air conditioner. For example, the present disclosure may be applied to a floor heating system, a radiation type heating system, a dehumidifier, a humidifier, an air purifier, or the like that has multiple operation modes.

Further, although the case is described above in which the control device 60 is disposed in the building 10, the control device 60 may be disposed outside of the building 10. For example, a server 70 on the Internet N2 may be made to function as the control device 60.

Figure 9:
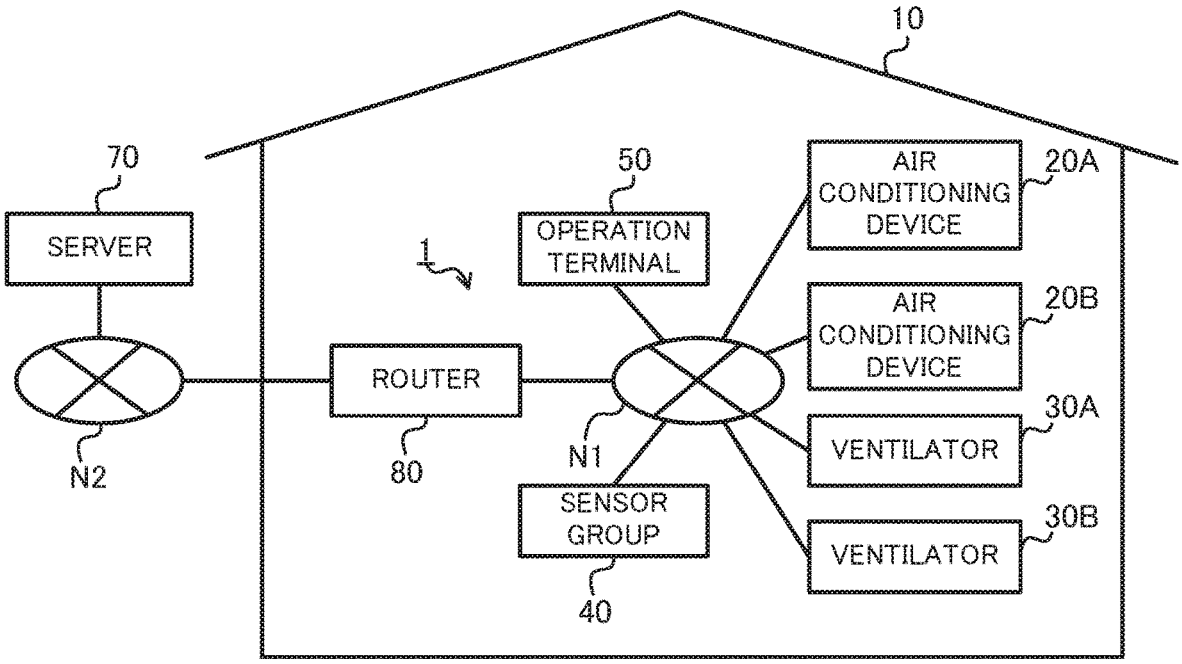
FIG. 9 is a drawing illustrating configuration of an air conditioning system according to another embodiment.

For example as in FIG. 9, within the building 10, a router 80 is disposed rather than the control device 60. Alternatively, the server 70 functioning as the aforementioned control device 60 is located on the Internet N2 outside of the building 10. In this case, the router 80 and the server 70 cooperatively perform the role of the control device 60.

Further, by an existing personal computer, information terminal, or the like using an operational program specifying operation of the control device 60 according to the present embodiment, the personal computer or the like can be made to function as the control device 60 according to the present disclosure.

Further, any method may be used for distribution of such a program, and for example, the program may be stored in a computer-readable recording medium such as a compact disc read-only memory (CD-ROM), a digital versatile disc (DVD), a magneto-optical (MO) disc, a memory card, or the like, and then the computer-readable recording medium storing the program may be distributed through a communication network such as the Internet.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure can be used with advantage for a system such as a home energy management system (HEMS) or the like.

REFERENCE SIGNS LIST

1 Air conditioning system
10 Building
11 LDK (living room, dining room, and kitchen)
12 Private room
13 Sink room
14 Bathing room
15 Toilet room
16A, 16B Air supply port
20, 20A, 20B Air conditioning device
21 Indoor unit
21A Indoor heat exchanger
21B Indoor blower

21C Indoor unit controller
21D Temperature sensor
21E Infrared sensor
22 Outdoor unit
22A Compressor
22B Outdoor heat exchanger
22C Expansion valve
22D Four-way valve
22E Outdoor blower
22F Outdoor unit controller
23 Remote controller
24 Refrigerant line
25 Communication line
30, 30A, 30B Ventilator
40 Sensor group
50 Operation terminal
60 Control device
61 Communicator
62 Storage
63 Controller
631 Air conditioning controller
632 Ventilation controller
70 Server
80 Router
N1 Indoor network
N2 Internet

The invention claimed is:

1. An air conditioning system comprising:

an air conditioning device configured to condition air in a target space;

a ventilator configured to ventilate the target space; and a ventilation controller configured to: (i) upon start of a maintenance operation by the air conditioning device for evaporation of water droplets attached to a heat exchanger included in an indoor unit of the air conditioning device, control the ventilator to operate continuously during the maintenance operation, and (ii) upon start of a heating operation or a cooling operation, control the ventilator to operate intermittently during the heating operation or the cooling operation, wherein the ventilation controller is configured to control the ventilator in accordance with a dust level or an odor level of air in the target space.

2. The air conditioning system according to claim 1, wherein the ventilation controller is configured to control the ventilator to operate after passage of a predetermined time period from start of the maintenance operation of the air conditioning device.

3. The air conditioning system according to claim 1, wherein the ventilation controller is configured to control the ventilator to stop after passage of a predetermined time period from end of the maintenance operation of the air conditioner device.

4. The air conditioning system according to claim 1, wherein the ventilation controller is configured to control the ventilator to operate for a predetermined time period after start of a dehumidification operation or an air blowing operation by the air conditioning device.

5. The air conditioning system according to claim 1, further comprising an air conditioning controller configured to control the air conditioning device to perform the maintenance operation when a user is absent from the target space.

6. The air conditioning system according to claim 1, wherein the ventilation controller is configured to control the ventilator such that a ventilation rate when a user is absent from the target space is greater than when the user is present in the target space.

7. The air conditioning system according to claim 1, further comprising a display configured to, when the ventilation controller controls the ventilator to operate in conjunction with operation of the air conditioning device, display in one screen in association with each other: (i) information indicating that the ventilator operates in conjunction with the operation of the air conditioning device, (ii) information relating to the operation of the air conditioning device, and (iii) information relating to operation of the ventilator.

8. A control device connected to an air conditioning device and a ventilator via a communication network, the control device comprising a ventilation controller configured to: (i) upon start of a maintenance operation by the air conditioning device for evaporation of water droplets attached to a heat exchanger included in an indoor unit of the air conditioning device, control the ventilator to operate continuously during the maintenance operation, and (ii) upon start of a heating operation or a cooling operation, control the ventilator to operate intermittently during the heating operation or the cooling operation, wherein the ventilation controller is configured to control the ventilator in accordance with a dust level or an odor level of air in the target space.

9. A non-transitory computer-readable recording medium storing a program, the program causing a computer connected to an air conditioning device and a ventilator via a communication network to function as:

a ventilation controller configured to: (i) upon start of a maintenance operation by the air conditioning device for evaporation of water droplets attached to a heat exchanger included in an indoor unit of the air conditioning device, control the ventilator to operate continuously during the maintenance operation, and (ii) upon start of a heating operation or a cooling operation, control the ventilator to operate intermittently during the heating operation or the cooling operation, wherein the ventilation controller is configured to control the ventilator in accordance with a dust level or an odor level of air in the target space.

10. The air conditioning system according to claim 1, wherein, to operate the ventilator intermittently upon start of the heating operation or the cooling operation, the ventilation controller is further configured to control the ventilator to operate for a predetermined time period at fixed time intervals during the heating operation or the cooling operation.

11. The control device according to claim 8, wherein, to operate the ventilator intermittently upon start of the heating operation or the cooling operation, the ventilation controller is further configured to control the ventilator to operate for a predetermined time period at fixed time intervals during the heating operation or the cooling operation.

12. The non-transitory computer-readable recording medium according to claim 9, wherein, to operate the ventilator intermittently upon start of the heating operation or the cooling operation, the ventilation controller is further configured to control the ventilator to operate for a predetermined time period at fixed time intervals during the heating operation or the cooling operation.

* * * * *